US005875603A

United States Patent [19]

Rudd

[11] Patent Number: 5,875,603

[45] Date of Patent: Mar. 2, 1999

[54] METAL AND WOOD COMPOSITE FRAMING MEMBERS FOR RESIDENTIAL AND LIGHT COMMERCIAL CONSTRUCTION

[75] Inventor: Armin F. Rudd, Cocoa, Fla.

[73] Assignee: University of Central Florida, Orlando, Fla.

[21] Appl. No.: 975,642

[22] Filed: Nov. 21, 1997

Related U.S. Application Data

[62] Division of Ser. No. 664,442, Jun. 21, 1996, abandoned.

[51] Int. Cl.[6] ..... E04C 3/30

[52] U.S. Cl. ..... 52/731.8; 52/730.7; 52/731.1; 52/731.9; 52/737.3; 52/376; 52/765

[58] Field of Search ..... 52/730.7, 731.1, 52/731.8, 731.9, 737.3, 776, 765, 699, 481.1

[56] References Cited

U.S. PATENT DOCUMENTS

| | | | |
|---|---|---|---|
| 3,531,901 | 10/1970 | Will et al. | 52/309 |
| 3,960,637 | 6/1976 | Ostrow | 156/293 R |
| 4,031,686 | 6/1977 | Sanford | 52/693 |
| 4,274,241 | 6/1981 | Lindal | 52/642 |
| 4,301,635 | 11/1981 | Neufeld | 52/483 |
| 4,875,316 | 10/1989 | Johnston | 52/204 |
| 5,072,547 | 12/1991 | DiFazio | 49/504 |
| 5,285,615 | 2/1994 | Gilmour | 52/729 |
| 5,440,848 | 8/1995 | Deffet | 52/376 |
| 5,452,556 | 9/1995 | Taylor | 52/730.7 |

*Primary Examiner*—Christopher Kent
*Assistant Examiner*—Yvonne Horton-Richardson
*Attorney, Agent, or Firm*—Law Offices of Brian S. Stienberger; Brian S. Steinberger

[57] ABSTRACT

Metal and wood composites are used to create framing members (studs and tracks, joists and bands, rafters, headers and the like.) for lightweight construction. Metal is utilized for its high strength, resistance to rot and insects, cost stability, and potentially lower cost through recycling. Metal that can be used includes roll formed steel approximately 18–22 gauge. Wood is used primarily for its lower thermal conductivity, and availability. The metal components form the primary structure while wood, either solid or other engineered wood, provides some structure and a thermal break. The invention connects J-shaped or triangular shaped metal forms to wood sections. The metal flange ends can have various J, C, L, right triangular, triangular, T and straight line cross-sectional shapes. The wood is fastened to the metal by machine pressing of the metal to wood. Alternatively the fastening includes nails, staples, screws, and the like, and also by adhesive glue. The outward faces of the metal members are pre-formed with four longitudinal ridges such that the contact surface area to applied sheathings is reduced by about 90%.

5 Claims, 7 Drawing Sheets

METAL AND WOOD COMPOSITE FRAMING MEMBERS FOR RESIDENTIAL AND LIGHT COMMERCIAL CONSTRUCTION

This is a Divisional of application Ser. No. 08/664,442 filed Jun. 21, 1996 now abandoned.

This invention relates to composite framing members, more specifically to studs and tracks, joists and bands, headers, and rafters formed from wood and metal composites.

BACKGROUND AND PRIOR ART

Residential and light commercial construction generally use wood as the primary building material for studs, plates, joists, headers and trusses. However, all-wood construction has problems. The rapidly rising cost of raw wood supplies has in effect substantially raised the cost of these members. Further, the quality of available framing lumber continues to decline. Finally, wood is flammable and susceptible to insects and rot.

Due to these problems, many builders have been switching to using all steel framing. The costs between using wood or steel framing is getting closer. In January 1990, the cost of framing lumber was about $225 per thousand board feet, peaking to highs of $500 in both January, 1993 and January 1994. Since June 1995, the framing lumber composite price has been rising from $300 per thousand board feet. Estimates from the AISI and NAHB Research Center state at a framing lumber cost of $340 to $385, there would be no difference between the cost of framing a house in steel as compared in wood. Thus, the break-even point between wood and steel framing is at about $360 per thousand board feet of framing lumber, and the lumber price has exceeded that point several times in recent years by as much as 40%, giving steel a competitive advantage.

Recycling has additionally helped the cost of steel to remain on a stable or downward trend. Steel costs have varied little in recent years. Traditionally variations can be correlated to steel demand by the automobile industry when demand is high, steel usually increases slightly in price. Consequently, the use of metal framing in residential and light commercial construction is increasing, a trend recognized and encouraged by the American Iron and Steel Institute (AISI).

All steel studs, tracks and trusses are being manufactured by Tri-Chord, HL Stud Corporation, Truswall Systems, Techbuilt Manufacturing, Knudson Manufacturing, John McDonald, and MiTek Ultra-Span Systems.

A problem with using all steel framing is its high thermal conductivity, leading to thermal bridging, "ghosting", and greater potential for water vapor condensation on interior wall surfaces. "Ghosting" is when an unsightly streak of dust accumulates on the interior wallboard, where the steel studs lie behind, due to an acceleration of dust particles toward the colder surface. Another problem of using all steel framing is the increased energy use for space conditioning (heating and cooling). Metal used for exterior framing members allows greater conduction heat transfer between the outside and inside surfaces of a wall, roof or floor. In colder climates, this increased conduction can cause condensation in interior surfaces, contributing to material degradation and mold and mildew growth. Metal framing also decreases the effectiveness of insulation installed in the cavity between the metal framing due to increased three dimensional thermal shorting effects. Higher sound transmission is another disadvantage of metal framing since sound conductivity is greater in metal than in wood. Electricians have more difficulty working with all steel framing when running holes for wiring since metal is more difficult to drill than wood, and grommets or conduits must be used to protect the wire.

U.S. Pat. No. 5,285,615 to Gilmour describes a thermal metallic building stud. However, the Gilmour member is entirely formed from metal. In Gilmour, the thermal conductivity is only partially reduced by having raised dimples on the ends contacting other building materials.

U.S. Pat. No. 3,960,637 to Ostrow describes impractical wood and metal composites. Ostrow requires each end flange have tapered channels, the end flanges being formed from extruded aluminum, molded plastic and fiberglass. Ends of the vertical wood web must be fit and pressed into a tapered channel. Besides the difficulty of aligning these parts together, other inherent problems exist. Extruding the channel flanges from aluminum or using molds, cuts and rolling to create the channelled plastic and fiberglass end flanges is expensive to manufacture. To stabilize the structures, Ostrow describes additional labor and manufacturing costs of gluing members together and sandwiching mounting blocks on the outsides of each channel.

Other metal and wood framing member patents of related but less significant interest include: U.S. Pat. Nos. 5,452,556 to Taylor; 5,440,848 to Deffet; 5,072,547 to DiFazio; 4,875,316 to Johnston; 4,301,635 to Neufeld; 4,274,241 to Lindal; 4,031,686 to Sanford; and 3,531,901 to Meechan.

SUMMARY OF THE INVENTION

The first objective of the present invention is to provide a metal/wood composite wall stud that increases the total thermal resistance of a typical steel framed insulated wall section by some 43percent and would eliminate interior condensation and "ghosting" for all but the coldest regions of the United States.

The second object of this invention is to provide a wood and metal composite framing combinations that achieve a resource efficient and economic construction framing member. Metal is used for its high strength, and potentially lower cost and resource efficiency through recycling. Wood is used primarily for its lower thermal conductivity and for its availability as a renewable resource, and for its workability.

The third object of this invention is to provide a wood and metal composite framing members that allows electricians to be able to route wires through walls in the same way they are accustomed to doing with solid framing lumber.

The fourth object of this invention is to provide a wood and metal composite framing member that would be easy to manufacture.

The fifth object of this invention is to provide a wood and metal composite framing member that has low sound conductivity compared to prior art steel framing members.

The sixth object of this invention is to provide a wood and metal composite framing member that has reduced effects from flammability compared to all wood members.

The invention includes J-shaped, L-shaped, triangular shaped cross-sectional metal forms (plate legs) connected by a wood midsections, whereby the wood is fastened to the metal by machine pressing of the metal to wood, similar to the common truss plate, or by nails, staples, screws, or other mechanical fastening means, or by adhesive glue. The outward faces of the metal members are pre-formed with four longitudinal ridges such that the contact surface area to applied sheathings is reduced by about 90%.

Metal and wood composites are used to create framing members (studs and tracks, joists and bands, headers, rafters, and the like) for light-weight construction. Metal is utilized for its high strength, resistance to rot and insects, cost stability, and potentially lower cost through recycling. Wood is used primarily for its lower thermal conductivity, and availability. The metal components form the primary structure while wood, either solid or other engineered wood, provides some structure and a thermal break. The metal used can be steel of approximately 18 to approximately 22 gauge.

Metal/wood composite framing members can be used in place of conventional wood framing members such as: 2×4 and 2×6 wall studs, and 2×8, 2×10, 2×12 and other dimensions of roof rafters, floor joists and headers. The novel framing members can be used to replace conventional light-gauge steel framing to reduce thermal transmittance and sound transmission.

Further objects and advantages of this invention will be apparent from the following detailed description of a presently preferred embodiment which is illustrated schematically in the accompanying drawings.

DESCRIPTION OF THE PREFERRED EMBODIMENT

Figure 1A:
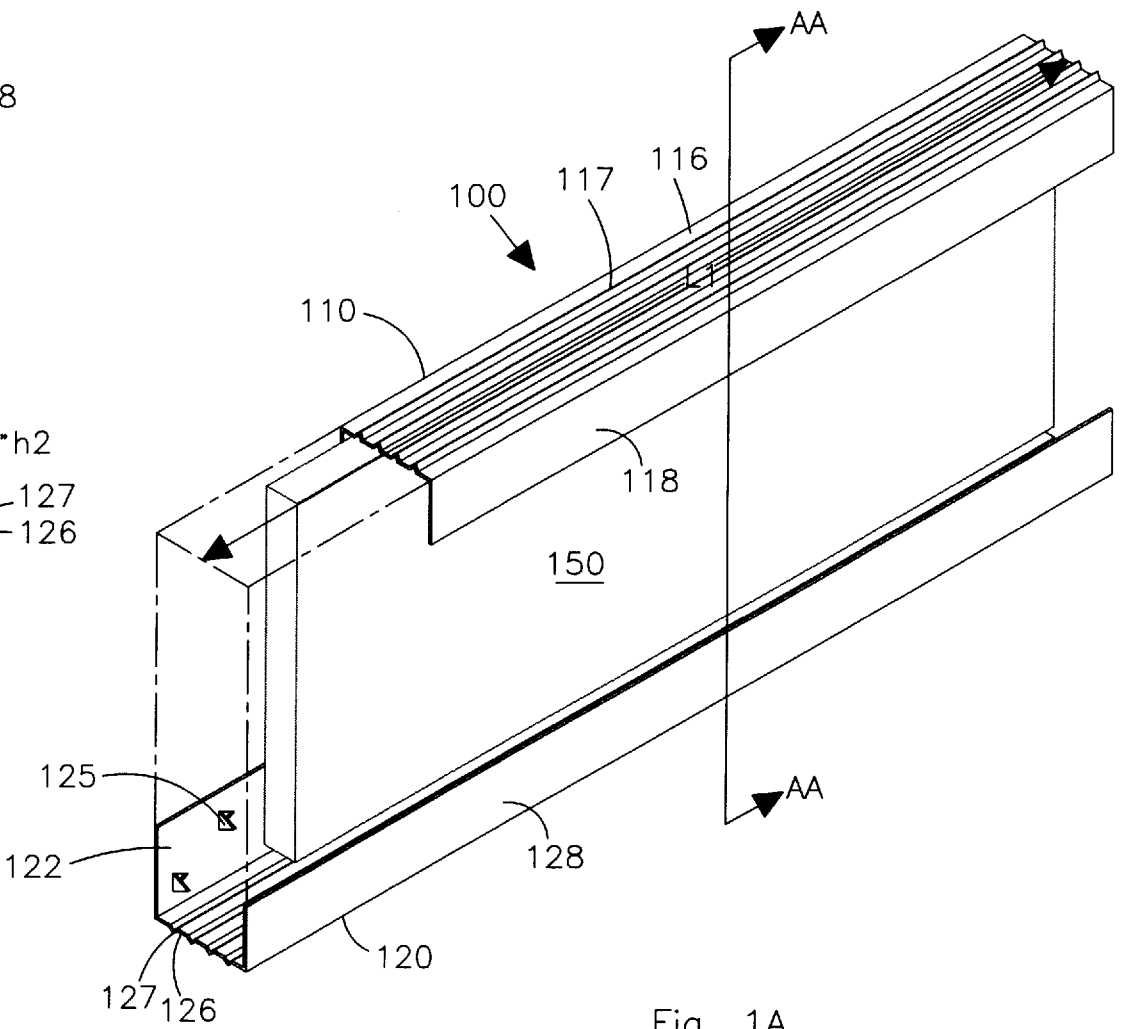
FIG. 1A is a perspective isometric view of a first preferred embodiment metal/wood stud.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

The preferred method of calculating thermal transmittance for building assemblies with integral steel is the zone method published by the American Society of Heating Refrigeration and Air-Conditioning Engineers (ASHRAE). A recent study by the National Association of Home Builders Research Center and Oak Ridge National Laboratory verified the usefulness of the zone method for calculating thermal transmittance for light gauge steel walls.

Thermal transmittance calculations were completed using the zone method for the metal/wood stud invention embodiments. Table 1 shows a comparison of thermal transmittance (given as total R-value) for nine wall configurations. The first wall listed is a conventional 2×4 wood frame wall with ½" plywood sheathing and R-11 fiberglass cavity insulation. The total wall R-value is 13.2 hr-F-ft$^2$/Btu. the second and third walls listed are conventional metal stud walls, one with ½" plywood sheathing (R-7.9) and the other with ½" extruded polystyrene sheathing (R-11.4). With conventional metal studs, high resistivity insulated sheathing is necessary to limit the large loss of total thermal resistance when low resistivity sheathings are used. In some cases, it is not desirable to use the non-structural insulated sheathing, such as when brick ties are needed, or when higher racking resistance is needed.

In comparison, the metalwood stud walls corresponding to those described in the subject invention has a 43 per cent greater total R-value than the conventional metal stud wall when using plywood sheathing. Thermal performance of tie metal/wood stud wall with plywood sheathing is nearly the same as the conventional wall with ½" extruded polystyrene (XPS insulated sheathing). Where non-structural sheathing is acceptable, fiber board sheathing, which is much less expensive than plywood, further increases the total R-value of the metal/wood stud wall.

TABLE 1

COMPARISON OF THERMAL TRANSMITTANCE FOR CONVENTIONAL METAL STUD WALL AND NOVEL METAL/WOOD STUD WALL

| Description | Stud Size Inch | Stud Spacing Inch O.C. | Cavity Insulation | Exterior Sheathing | Total R-Value |
|---|---|---|---|---|---|
| 1. Conventional metal stud,* | 1.625 × 3.625 | 24 | R-11 | ½" plywood | 7.9 |
| 2. Conventional metal stud,* | 1.625 × 3.625 | 24 | R-11 | ½" XPS | 11.4 |
| 3. Novel metal/wood stud, | 1.5 × 3.5 | 24 | R-11 | ½" plywood | 11.3 |
| 4. Novel metal/wood stud | 1.5 × 3.5 | 24 | R-13 | ½" plywood | 12.8 |
| 5. Novel metal/wood stud | 1.5 × 3.5 | 24 | R-15 | ½" plywood | 14.2 |
| 6. Novel metal/wood stud | 1.5 × 3.5 | 24 | R-11 | ½" fiber board | 12.1 |
| 7. Novel metal/wood stud | 1.5 × 3.5 | 24 | R-13 | ½" fiber board | 13.6 |
| 8. Novel metal/wood stud | 1.5 × 3.5 | 24 | R-15 | ½" fiber board | 15.0 |

*Conventional metal stud values from "Thermodesign Guide for Exterior Walls, American Iron and Steel Institute, Washington, D.C., Pub. No. RG-9405, Jan. 1995.

Comparison of vertical, transverse, and racking load capacities of 2 × 4 wood stud, metal stud, and subject invention wood/metal composite stud. Structural analysis by Kim McLeod, P.E. Of Keymark Enterprises, Boulder, Colorado.

Summary calculation results compared the allowable axial load for stud elements subjected to combined loading with axial and bending components. The three elements analyzed were a conventional 2×4 wood, a conventional 20 gauge steel stud, and the present invention metal/wood composite stud. All elements were 8' tall, and spaced 16" O.C. Wind (transverse) load at 110 mph. Table 2 shows that the metal/wood composite section can support 54% more weight than the metal stud, and 250% more weight than the wood stud. This gives the opportunity for further cost optimization by increasing the spacing which would reduce the number of studs required, or for reducing the amount of steel used in the composite section.

TABLE 2

STRUCTURAL CALCULATION RESULTS FOR NOVEL METAL/WOOD STUD

| Allowable Axial Load | 2 × 4 Wood Stud | 3.5" 20 Gauge Metal Stud | 3.5" Metal/Wood Composite Section |
|---|---|---|---|
| 8' tall stud 16" O.C. 110 mph wind | 551 lb | 894 lb | 1378 lb |

Figure 1B:
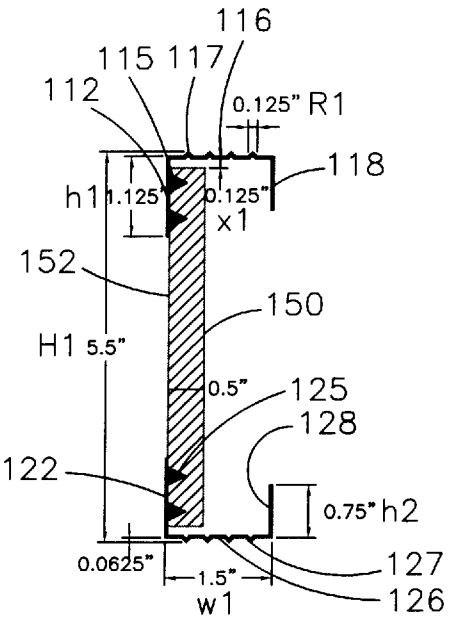
FIG. 1B is a cross-sectional view of the embodiment of FIG. 1A along arrow AA.

FIG. 1A is a perspective isometric view of a first preferred embodiment metal/wood stud 100. FIG. 1B is a cross-sectional view of the embodiment 100 of FIG. 1A along arrow AA. Referring to FIGS. 1A–1B, embodiment 100 includes metal forms 110, 120 such as but not limited to 20 gauge steel has been cold-formed in a roll press into a cross-sectional channel J-shape. Each form 110, 120 includes steel web portions 112, 122 that have staggered rows of cutout portions 115, 125 which are of a pressed tooth type triangular shape. Web portions 112, 122 are perpendicular to flanges 116, 126 which include approximately 4 rows of raised V-shaped grooves 117, 127 running longitudinally along the exterior of the flanges 116, 126. Flange returns 118, 128 are perpendicular to flanges 116, 126. Teeth 115, 125 can be hydraulically pressed adjacent the top and bottom rear side 152 of central web board 150. Central web board 150 can be solid wood, OSB, (oriented strand board) plywood and the like, having a thickness of approximately ½ an inch. Alternatively, web portions 112, 122 of forms 110, 120 can be fastened to the central web board 150 by nails, screws, staples and the like, or adhesively glued. A finished metal/wood stud 100 can have a length, L1, of approximately 8 feet or longer, height H1 of approximately 3.5 to 5.5 inches, width W1 of approximately 1.5 inches. Web portions 112, 122 can have a height, h1 of approximately 1.125 inches, front plate height, h2 of approximately 0.75 inches, raised grooves R1, of approximately 0.125 inches. A spacing, x1 of approximately 0.125 inches separates each flange 116, 126 from the top and bottom of central web board 150.

Figure 2A:
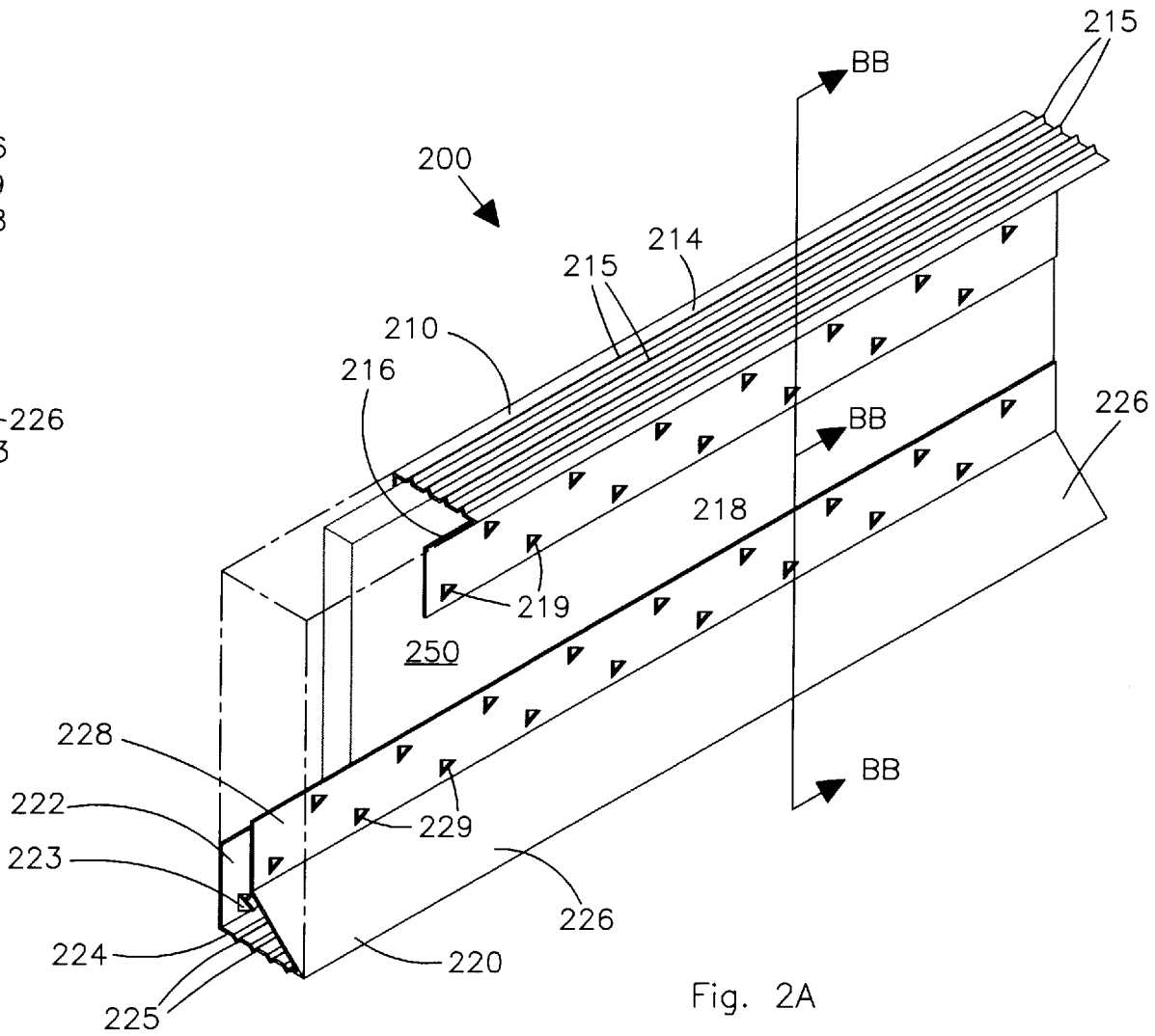
FIG. 2A is a perspective isometric view of a second preferred embodiment metal/wood stud.
Figure 2B:
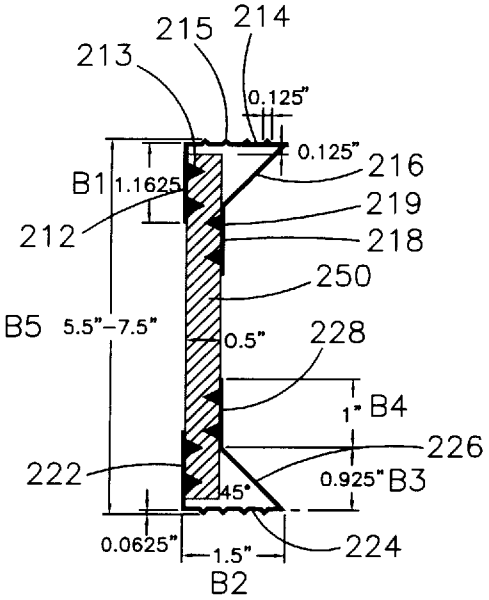
FIG. 2B is a cross-sectional view of the embodiment of FIG. 2A along arrow BB.

FIG. 2A is a perspective view of a second preferred embodiment metal/wood stud 200. FIG. 2B is a cross-sectional view of the embodiment 200 of FIG. 2A along arrow BB. Referring to FIGS. 2A–2B, embodiment 200 includes metal forms 210, 220 such as but not limited to 20 gauge steel that has been roll pressed into a cross-sectional channel right-triangular-shape. Each form 210, 220 includes outer web portions 212, 222 that have staggered rows of cut-out portions 213, 223 which are of a pressed tooth type triangular shape. Outer web portions 212, 222 are perpendicular to flanges 214, 224 which include approximately 4 rows of raised V-shaped grooves 215, 225 running longitudinally along their exterior surface. Flange returns 216, 226 are approximately 45 degrees to flanges 214, 224, and are connected to inner web portions 218, 228 each having staggered rows of cut-out portions 219, 229 which also are of the pressed tooth type triangular shape. Teeth 213, 219 and 223, 229 can be firmly pressed adjacent the top and bottom of central web board 250. Central web board 250 can be solid wood, OSB, plywood and the like, having a thickness of approximately ½ an inch. Alternatively, web portions 212, 218, 222, 228 can be fastened to the central web board 250 by nails, screws, staples and the like. Outer web portions 212, 222 can have a height, B1 of approximately 1.1625 inches, flanges 214, 224 can have a width, B2 of approximately 1.5 inches, flange returns 216, 226 can have a height, B3 of approximately 0.925 inches and inner web portions 218, 228 can have a height, B4 of approximately 1 inch. A finished metal/wood stud 200 can have the remaining dimensions and spacings similar to the embodiment 100 previously described, except height, B5 can be approximately 5.5 to approximately 7.25 inches.

Figure 3A:
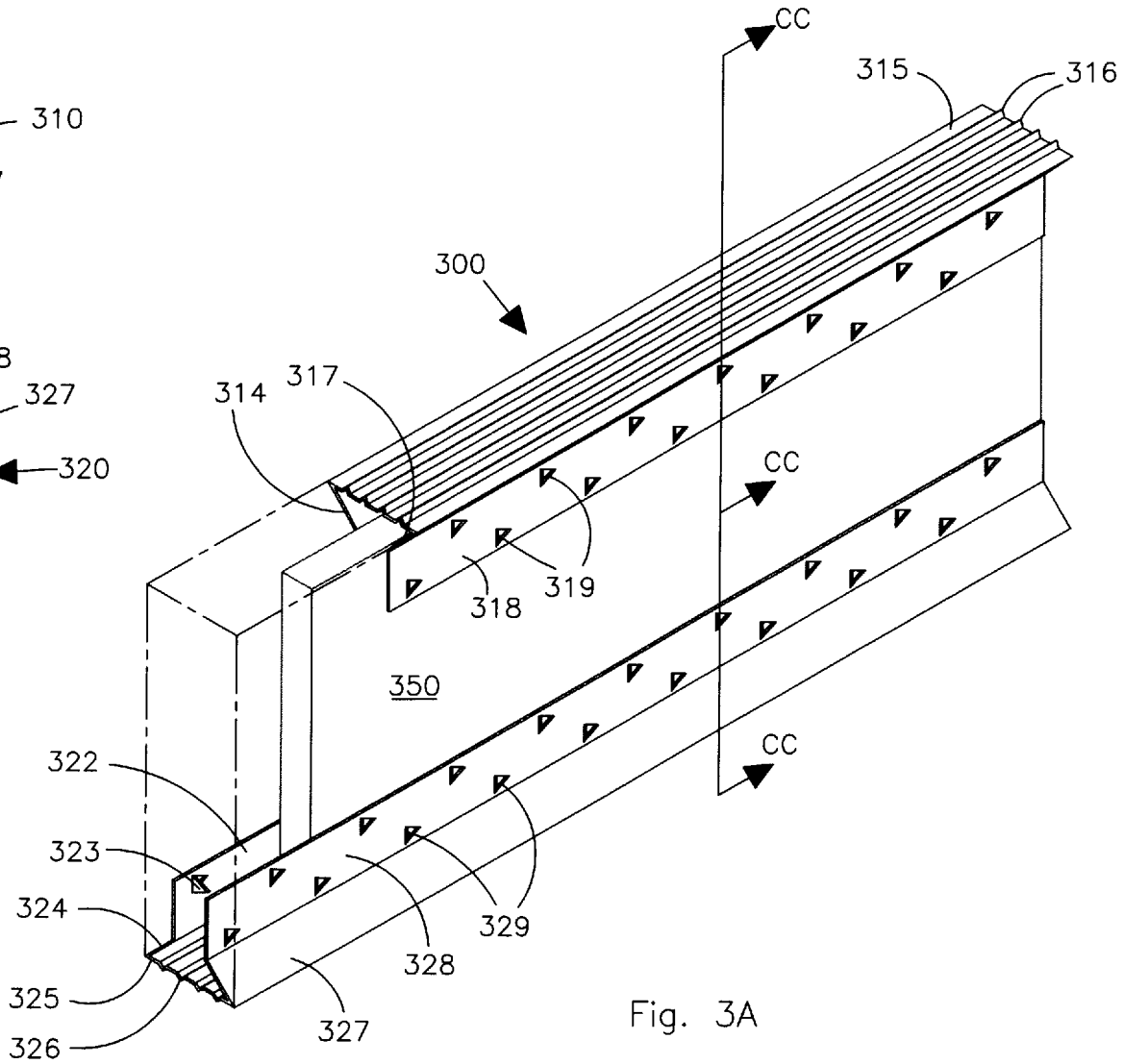
FIG. 3A is a perspective isometric view of a third preferred embodiment metal/wood stud.
Figure 3B:
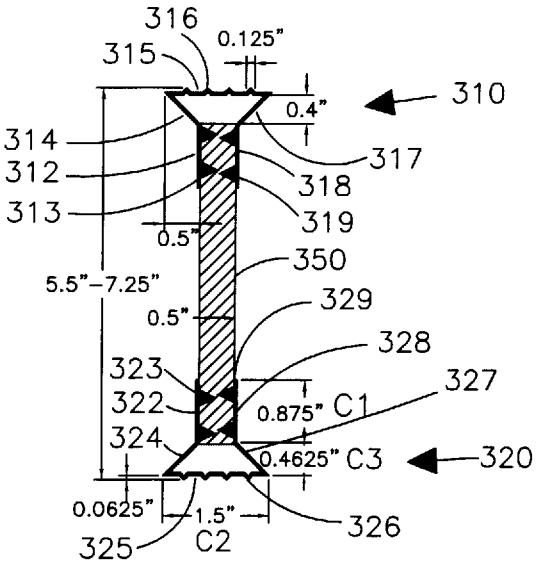
FIG. 3B is a cross-sectional view of the embodiment of FIG. 3A along arrow CC.

FIG. 3A is a perspective isometric view of a third preferred embodiment metal/wood stud 300. FIG. 3B is a cross-sectional view of the embodiment 300 of FIG. 3A along arrow CC. Referring to FIGS. 3A–3B, embodiment 300 includes metal forms 310, 320 such as but not limited to 20 gauge steel has been roll pressed into a cross-sectional channel triangular-shape with parallel plates on the apex of the triangle. Each form 310, 320 includes metal web portions 312, 322, 318, 328 that have staggered rows of cut-out portions 313, 323, 319, 329 which are of a pressed tooth type triangular shape. Web portions 312, 322, 318, 328 attach to 45 degree flange returns 314, 324 which are attached to respective flanges 315, 325 which include approximately 4 rows of raised V-shaped grooves 316, 326 running longitudinally along their exterior surface. Teeth 313, 319 and 323, 329 can be pressed adjacent the top and bottom of central web board 350. Central web board 350 can be solid wood, OSB, plywood and the like, having a thickness of approximately ½ an inch. Alternatively, metal web portions 312, 318, 322, 328 can be fastened to the central web board 350 by nails, screws, staples and the like. Metal web portions 312, 318, 322, 328 can have a height, C1 of approximately 0.875 inches, flanges 315, 325 can have a width, C2 of approximately 1.5 inches, flange returns 314, 317, 324, 327 can have a height, C3 of approximately 0.4625 inches. A finished metal/wood stud 300 can have remaining dimensions and spacings similar to the embodiment 200 previously described.

Figure 4A:
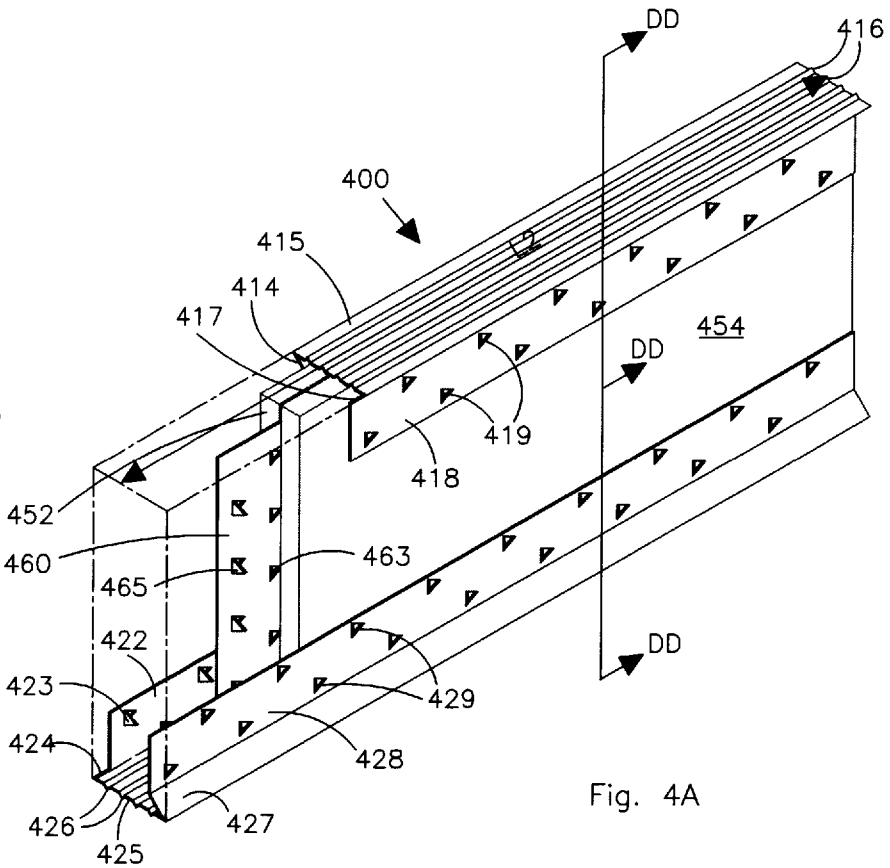
FIG. 4A is a perspective isometric view of a fourth preferred embodiment metal/wood joist, rafter and header.
Figure 4B:
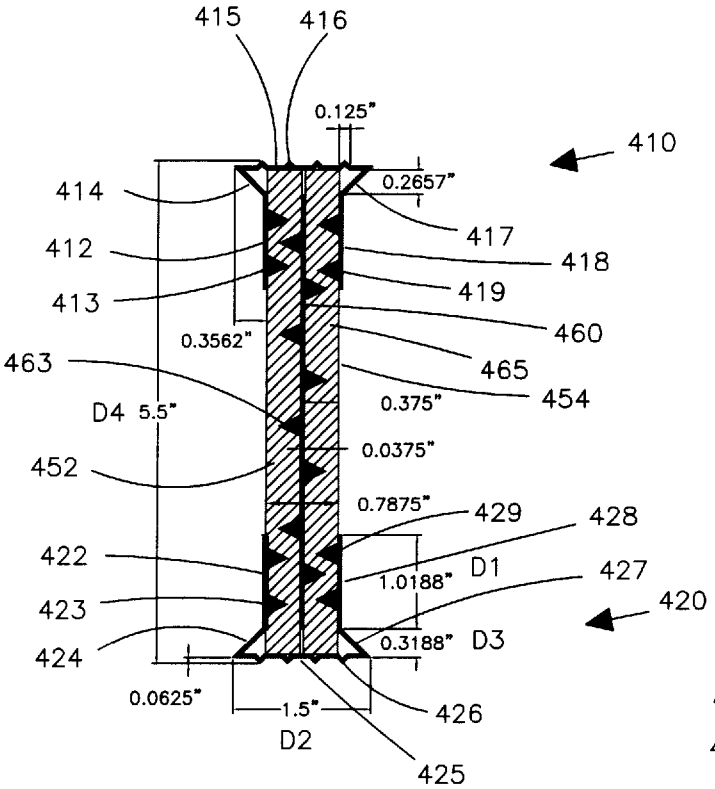
FIG. 4B is a cross-sectional view of the embodiment of FIG. 4A along arrow DD.

FIG. 4A is a perspective isometric view of a fourth preferred embodiment 400 useful as a metal/wood joist, rafter and header. FIG. 4B is a cross-sectional view of the embodiment 400 of FIG. 4A along arrow DD. Referring to FIGS. 4A–4B, embodiment 400 includes metal forms 410, 420 such as but not limited to 20 gauge steel has been roll pressed into a cross-sectional channel triangular-shape with parallel plates on the apex of the triangle. Each form 410, 420 includes metal web portions 412, 422, 418, 428 that have staggered rows of cut-out portions 413, 423, 419, 429 which are of a pressed tooth type triangular shape. Metal web portions 412, 422, 418, 428 attach to 45 degree flange returns 414, 424, 417, 427 which are attached to respective flanges 415, 425 which include approximately 4 rows of raised V-shaped grooves 416, 426 running longitudinally along their exterior surface. Teeth 413, 419 and 423, 429 can be pressed adjacent the top and bottom portions of central web boards 452, 454. A central metal plate 460 has left facing tooth rows 463 and right facing tooth rows 465 for connecting to adjacent respective web boards 452, 454. Plate 460 has a spacing above and below to separate such from flanges 415, 425. Central web boards 452, 454 can be solid wood, OSB, plywood and the like, having a thickness of approximately 0.375 inches. Alternatively, metal web portions 412, 418, 422, 428 can be fastened to the central web boards 452, 454 by nails, screws, staples and the like. Metal web portions 412, 418, 422, 428 can have a height, D1 of approximately 1.0188 inches, flanges 415, 425 can have a width, D2 of approximately 1.5 inches, flange returns 414, 417, 424, 427 can have a height, D3 of approximately 0.3188 inches. A finished embodiment 400 can have practically any length, L2 to serve as a floor joist, rafter or header, width D2 can be approximately 1.5 inches and height D4, can be approximately 5.5 inches or more.

Figure 5C:
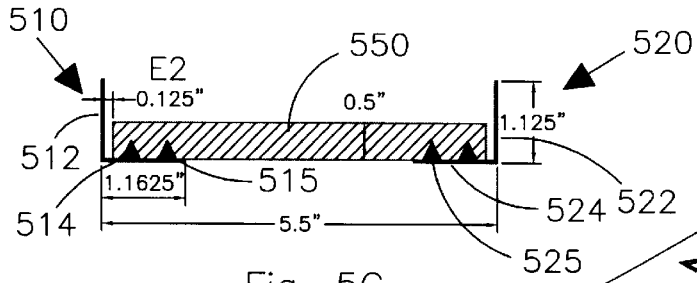
FIG. 5C is a cross-sectional view of the embodiment of FIG. 5B along arrow EE.
Figure 5A:
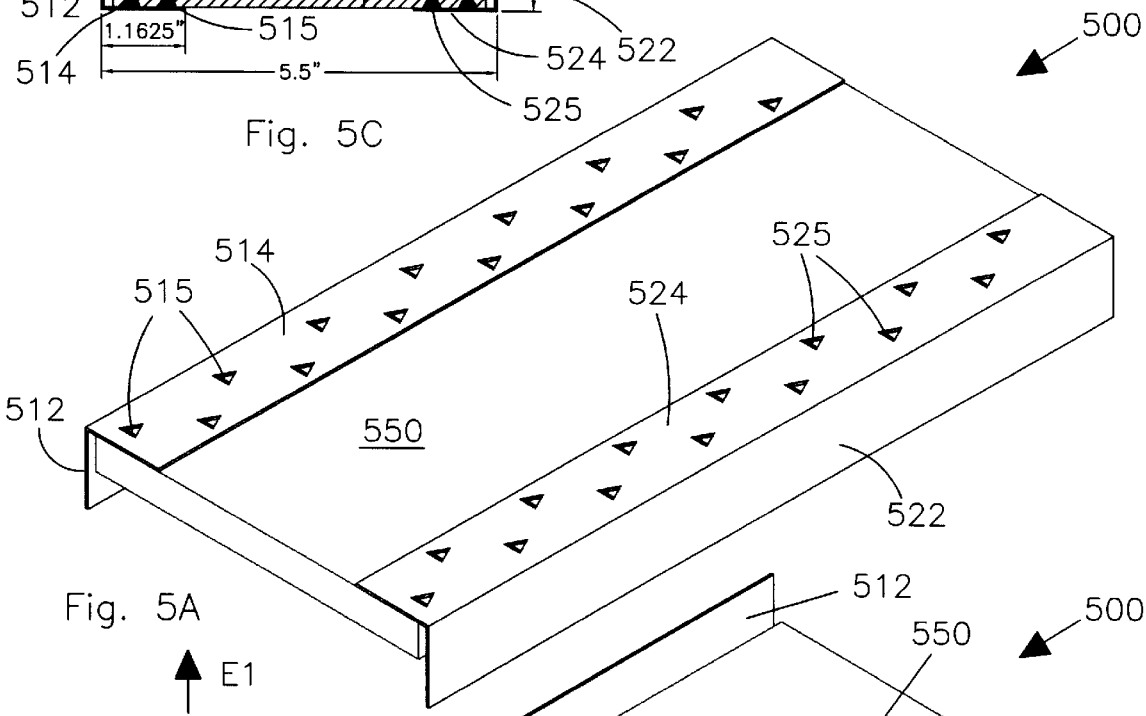
FIG. 5A is a top perspective view of a fifth embodiment track for metal/wood stud systems.
Figure 5B:
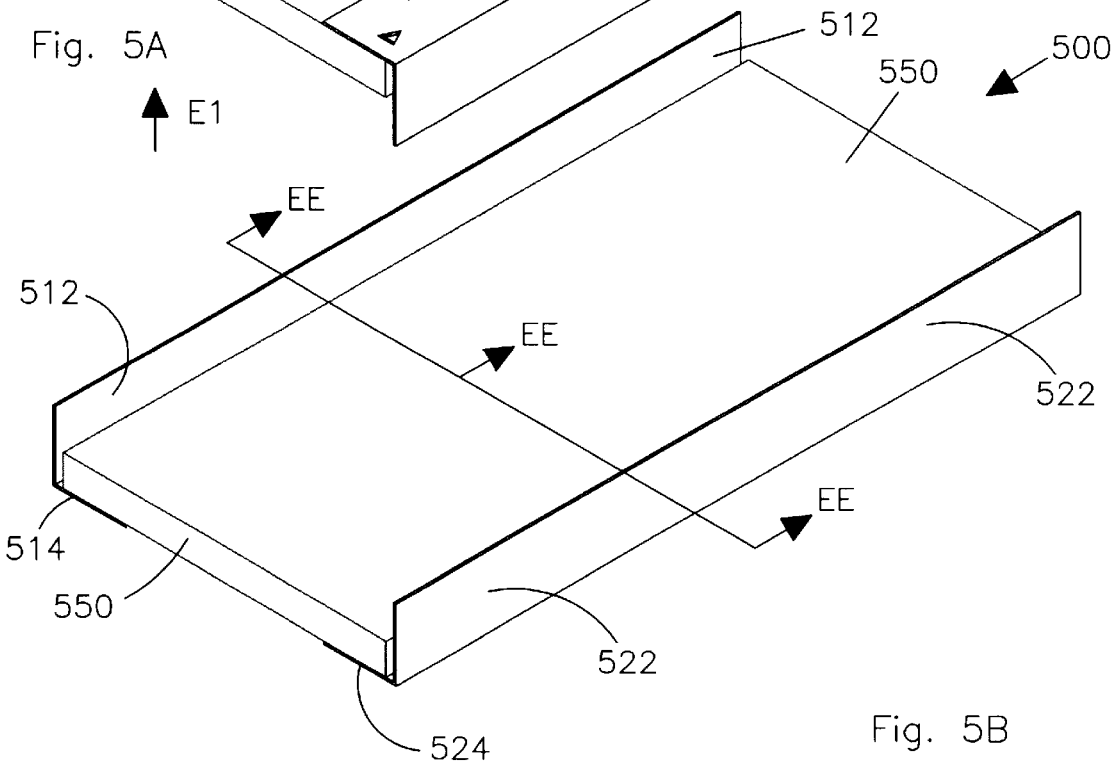
FIG. 5B is a bottom perspective view of the embodiment of FIG. 5A along arrow E1.

FIG. 5A is a top perspective view of a fifth embodiment track 500 for metal/wood stud and track systems. FIG. 5B is a bottom perspective view of the embodiment 500 of FIG. 5A along arrow E1. FIG. 5C is a cross-sectional view of the embodiment 500 of FIG. 5B along arrow EE. Referring to FIGS. 5A–5C, embodiment 500 includes metal forms 510, 520 each having a generally L-shaped cross-section. Forms 510, 520 each include flanges 512, 522 approximately 1.125 inches in height perpendicular to metal web portions 514, 524, which are approximately 1.1625 inches in length. Metal web portions 514, 524 have tooth shaped triangular cut-outs 515, 525, which are pressed into sides of center-web-board 550. A spacing E2 of approximately 0.125 inches separates the ends of center-web-board 550 from flanges 512, 522, respectively. A finished embodiment 500 can have remaining dimensions and spacings similar to the embodiments 100, 200, and 300 above.

Figure 6B:
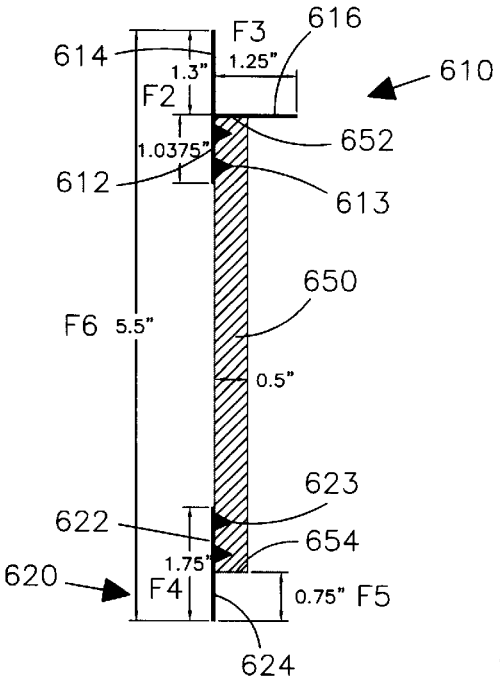
FIG. 6B is a cross-sectional view of the embodiment of FIG. 6A along arrow FF.
Figure 6A:
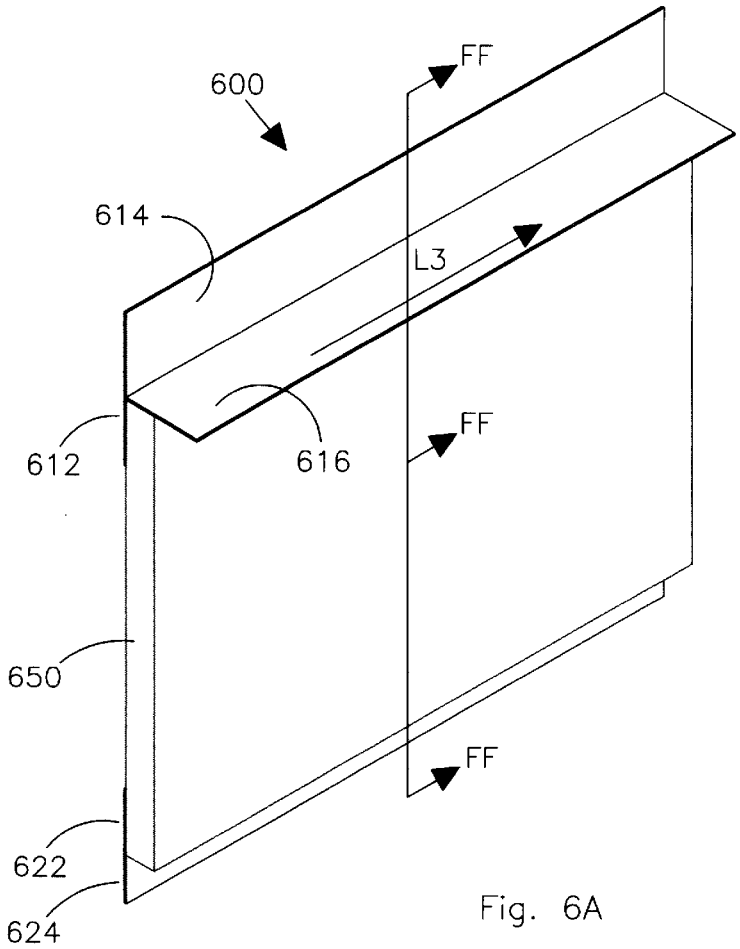
FIG. 6A is a perspective view of a sixth preferred embodiment metal/wood band.

FIG. 6A is a perspective view of a sixth preferred embodiment metal/wood joists and bands 600. FIG. 6B is a cross-sectional view of the embodiment 600 of FIG. 6A along arrow FF. Referring to FIGS. 6A–6B, embodiment 600 includes top metal form 610 having a T-cross-sectional shape and lower metal form 620 having a straight line cross-sectional shape. Form 610 includes metal web portion 612, having a length, F1 of approximately 1.0375 inches having tooth shaped triangular cut-outs 613 which are pressed into upper end sides of wood center web board 650. Form 610 further includes an upright leg 614 having a length F2 of approximately 1.3 inches, perpendicular to a third leg 616, having a length, F3 of approximately 1.25 inches, which abuts against and overlaps top end 652 of centerboard 650. Lower metal form 620 has a metal web portion 622 having tooth shaped triangular cut-outs 623 which are pressed into upper end sides of wood center board 650, and a continuous extended plate 624. The continuous width F4, of metal plate 622, 624 is approximately 1.75 inches, with plate 624 extending a length F5 of approximately 0.75 inches from the lower end 654 of center-web-board 650 having thickness of approximately 0.5 inches. A finished embodiment 600 can have a width F6 and length L3 similar to embodiment 400.

Figure 7:
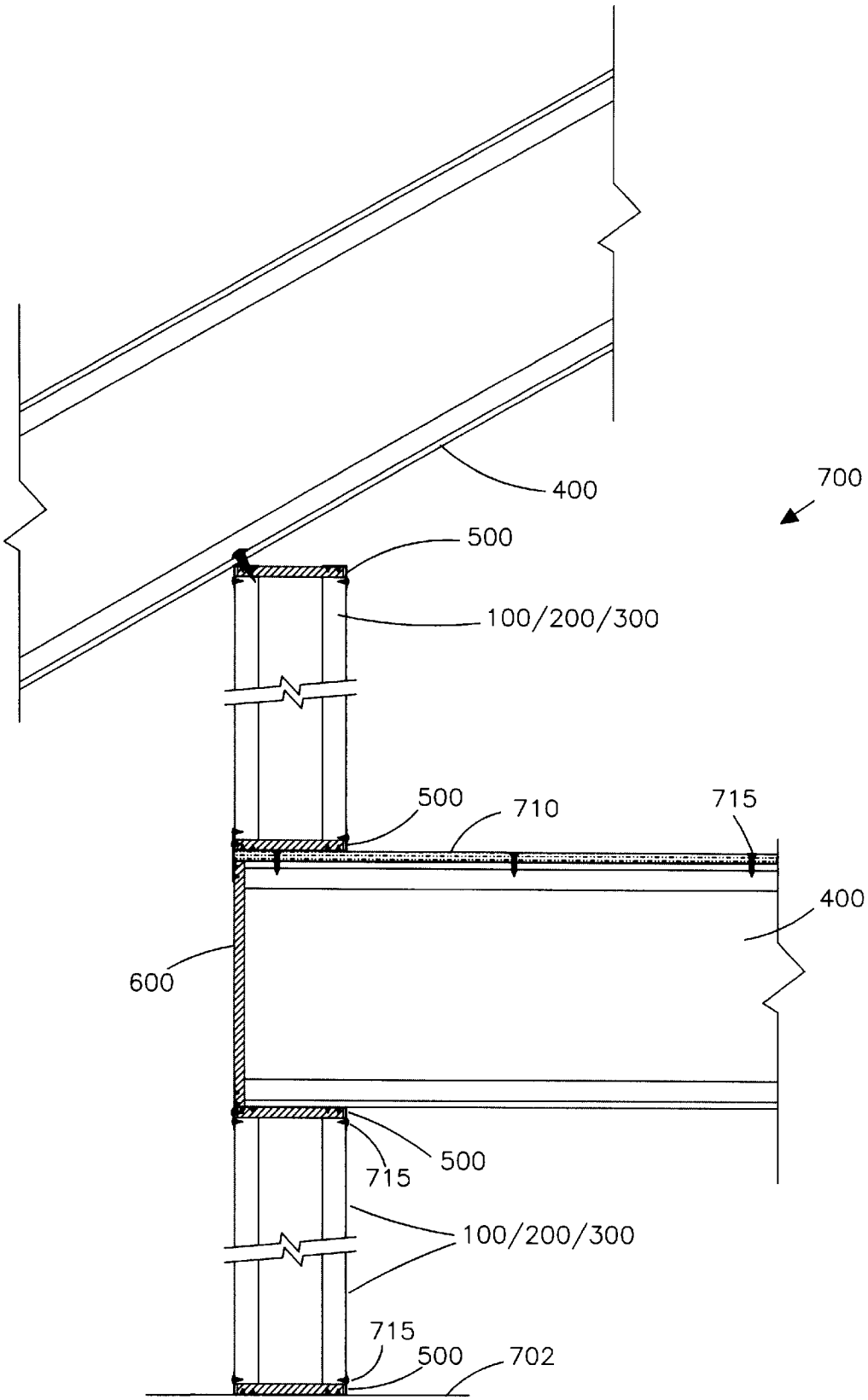
FIG. 7 is a cross-sectional view a framing system utilizing the embodiments of FIGS. 1A–6B.

FIG. 7 is a cross-sectional view a framing system 700 utilizing the embodiments of FIGS. 1A–6B. Embodiment 700 can be a two story building having a metal/wood bottom track 500 attached at floor 702 by conventional fasteners such as nails, screws, bolts and the like. Vertically oriented metal/wood studs 100/200/300 can be attached to floor and ceiling tracks 500 by steel framing screws 715 and the like. A metal/wood band 600 attaches first floor ceiling track 500 to metal/wood floor joist 400 and subfloor 710, which has conventional steel framing flathead type screws 716 and the like. The second floor has a similar arrangement with rafters 400 attached at conventional angles to upper metal/wood top track 500.

A cost of a metal/wood composite stud such as those described in the previous embodiment 100 is estimated to be $4.24. The lowest cost of conventional 20 gauge steel studs is $2.52 each, however, to obtain the same thermal performance, an insulated sheathing is required which raises the cost to $4.55 per stud. The metal/wood framing member's invention is directly cost effective compared to the conventional metal stud. In addition, structural calculations show that the metal/wood stud configuration can support 54% more weight at the same 8' wall height, 16" O.C. spacing, and 110 mph wind load. This give opportunity for further cost optimization by increasing the spacing which would reduce the number of studs required. For example, a 2000 square foot house framed 16" O.C. will have about 168 conventional steel exterior wall studs, the same house framed 24" O.C. with the stronger metal/wood composite exterior wall studs will use only 107 studs. With 61 fewer exterior wall studs required, the builder can save about $270.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended. For the claims, the invention will be described as having all metal portions including the forms to be referred to as flanges, and all mid wood portions will be referred to as wood web members.

I claim:

1. A framing member for banding ends of floor joists, formed from mixed composite materials which is used for residential and light commercial construction, the framing member comprises:

a substantially horizontal elongated web member having a first long side, a second long side opposite the first long side, a first end and a second end, the web member formed from a first material;

a T-shaped form connected to the first end of the first long side of the web member; and a planar plate connected to the second of the second long side of the web member, the T-shaped form and the planar plate are formed from a second material, so that the first material and the second material are dissimilar from one another, thereby increasing thermal resistance and load capability while also reducing interior condensation and ghosting.

2. The framing member of claim 1, wherein the web member is formed from wood, and the T-shaped form and the planar plate are both formed from metal.

3. The framing member of claim 1, wherein a portion of the T-shaped form and a portion of the planar plate extend in opposing directions away from the web member.

4. The framing member of claim 1, wherein the T-shaped form has a web portion flush against the first long side of the web member.

5. A framing member for banding ends of floor joists, formed from mixed composite materials which is used for residential and light commercial construction, the framing member comprises:

a substantially horizontal elongated wood web member having a first long side, a second long side opposite the first long side, a first end and a second end, a metal T-shaped form connected to the first end of the first long side of the web member, the T-shaped form has a web portion flush against the first long side of the web member; and a metal planar plate connected to the second in of the first long side of the web member, a portion of the T-shaped form and a portion of the planar plate extend in opposing directions away from the web member, thereby increasing thermal resistance and load capability while also reducing interior condensation and ghosting.

* * * * *